US006446821B1

(12) United States Patent
Salisbury

(10) Patent No.: US 6,446,821 B1
(45) Date of Patent: Sep. 10, 2002

(54) BABY BOTTLE WITH INTEGRAL FLUID DELIVERY MEASUREMENT SYSTEM

(76) Inventor: Mason W. Salisbury, 75 Weed Dr. Extension, Columbia, SC (US) 29212

( * ) Notice: Subject to any disclaimer, the term of this patent is extended or adjusted under 35 U.S.C. 154(b) by 0 days.

(21) Appl. No.: 09/291,362

(22) Filed: Apr. 14, 1999

(51) Int. Cl.[7] ..... A61J 9/00
(52) U.S. Cl. ..... 215/11.1; 33/379
(58) Field of Search ..... 215/11.1; 33/365, 33/379; D7/305, 507; D9/436, 516

(56) References Cited

U.S. PATENT DOCUMENTS 2,514,744 A * 7/1950 Cipyak ..... 215/12.1
3,028,983 A * 4/1962 Barr ..... 215/11.1 X
3,145,867 A * 8/1964 Roberts et al. ..... 215/11.1
3,232,467 A * 2/1966 Barton ..... 215/11.1 X
4,676,387 A * 6/1987 Stephenson et al. ..... 215/11.1
4,793,533 A * 12/1988 Yang ..... 215/11.1 X
4,940,151 A * 7/1990 Fett ..... 215/11.1
5,044,509 A * 9/1991 Petrosky et al. ..... 215/11.1 X
5,207,338 A * 5/1993 Sandhu ..... 215/11.1
5,263,599 A * 11/1993 Sklar ..... 215/11.1
5,531,338 A * 7/1996 Sklar ..... 215/12.1

* cited by examiner

*Primary Examiner*—Lee Young
*Assistant Examiner*—Joseph C. Merek

(57) ABSTRACT

In accordance with the present invention, there is provided a baby bottle having gradations that allow for accurate measure of the fluid contained and/or dispensed from the bottle, wherein the gradations read true when held in a predetermined feeding angle. Invention bottles further comprise a leveling apparatus for determining when the bottle is being held at the angle whereby the gradations show the true volume.

9 Claims, 1 Drawing Sheet

BABY BOTTLE WITH INTEGRAL FLUID DELIVERY MEASUREMENT SYSTEM

FIELD OF THE INVENTION

The present invention relates to a fluid delivery system for infants. More particularly, the present invention is directed to a device for monitoring the amount of liquid dispensed from a baby bottle without interrupting the feeding of the infant.

BACKGROUND

As parents the world over have come to understand, feeding babies via baby bottles involves substantially more than just popping the bottle in the baby's mouth and waiting for it to run dry. Many babies are somewhat finicky regarding their dining habits. If you are able to get the baby to take the bottle, then feeding must often be regulated in order to keep the baby interested in getting sufficient nourishment, while at the same time preserving healthy gastric function. To compound the problem, feeding habits change as the baby grows, likely due to factors such as increased digestive capacity. New parents are informed by nurses and pediatricians that when a child is a newborn she should be burped regularly, generally after every ounce. If the bottle is removed too soon, the child will not have to burp and may cry and lose interest in eating; however, if you wait too long, the child is more likely to spit up and then lose interest in eating. As the baby gets older, the burping time is delayed until after the infant has taken two to three ounces. This pattern of burping continues throughout the bottle-feeding period. Accordingly, the problem encountered by parents is that the amount of formula delivered must be monitored without interrupting the feeding.

Currently, baby bottles do not have markings on the side of the bottle to indicate, while the bottle is maintained in the feeding position, how much formula is remaining in the bottle. Accordingly, there exists a need for an improvement of the baby bottle in order to assist parents in knowing how much and how quickly their child is eating.

BRIEF DESCRIPTION OF THE DRAWINGS

The present invention provides a means for monitoring the fluid level in a baby bottle, while the bottle is being maintained in the feeding position.

BRIEF DESCRIPTION OF THE FIGURES

Figure 1:
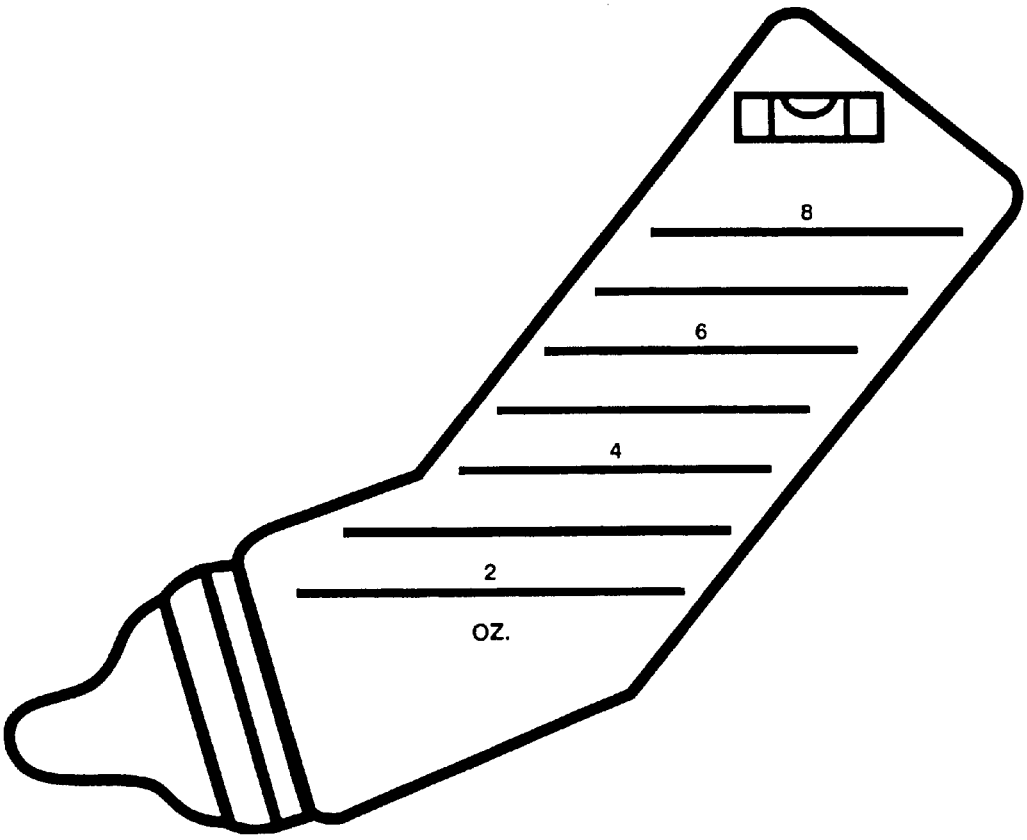

FIG. 1 depicts an example of a baby bottle with gradation marks and a leveling means.

Detailed Description of the Invention

In accordance with the present invention, there is provided an open-ended nursing bottle, said nursing bottle comprising:

(a) a plurality of visible gradations along its length, (b) a means for identifying an orientation of the nursing bottle that places a liquid contained therein in an aspect for measuring the liquid using the gradations when the nursing bottle is positioned for nursing, and (d) a receiving means on the open end for snugly accepting a dispensing means.

As will be readily understood by those of skill in the art, in order to accurately measure a liquid contained in a baby bottle, while the bottle is in the feeding position, the gradations must measure true in the feeding position. As will be further understood by those of skill in the art, gradations will only measure true in one orientation of the bottle. Accordingly, there must be a means to insure that the bottle is oriented so that the gradations measure true; this is accomplished by use of the leveling means incorporated into invention bottles. In one embodiment of the present invention, the leveling means is a bubble level. The bubble level contemplated for use in accordance with the present invention will, when reading level, indicate the orientation at which the gradations accurately show the volume of liquid contained in the bottle. In another embodiment of the present invention, the leveling means comprise the gradations themselves. In this embodiment, the gradations are parallel to one another and are of sufficient dimension (i.e., length) such that when the gradations are parallel with the force of gravity (i.e., parallel with the floor), the meniscus of the liquid can be visually oriented to be parallel with the gradations. In this manner, the gradations will also read true at only one orientation, that orientation being when the gradation marks and the level of the liquid are in alignment. Other leveling means which serve the purpose of indicating the orientation of the bottle wherein the gradations read true are also contemplated for use in accordance with the present invention. Although not listed here, such means are contemplated as within the scope of the present invention.

Of course the gradations described herein will have numerical values associated with them. Typically, such values will be in ounces, however, any unit of volumetric measure may be used in accordance with the present invention. Such values can either indicate the amount of liquid remaining in the bottle, or the amount of liquid dispensed from the full bottle. Dual sets of values indicating both amounts are also contemplated.

When feeding a bottle to a child, the bottle is typically held at an angle, to facilitate comfortable feeding. Accordingly, it is further contemplated that the gradations will be oriented at an angle so that they read true in a position that is comfortable for feeding a baby. Accordingly, a wide range of orientation angles will be useful and are contemplated for use in accordance with the present invention. In one embodiment of the present invention, the gradation lines will be oriented anywhere in the range of parallel with the bottom of the bottle to approximately perpendicular with the bottle bottom. In another embodiment of the present invention, the gradation lines will be oriented anywhere in the range of about 30 degrees with respect to the bottle bottom up to about 60 degrees. In another embodiment of the present invention, the gradation lines will be oriented at about 45 degrees with respect to the bottle bottom.

As those of skill in the art will readily appreciate, the bottle may incorporate a bend proximal to the mouth of the bottle in order to facilitate holding the bottle at a comfortable angle for feeding while providing for reduced opportunity for air bubbles to be conveyed into the nipple at low fluid volumes. Typically such bends are in the rage of 30 up to about 60 degrees, and the like. Such bottle designs are contemplated for use in accordance with the present invention. Accordingly, in another embodiment of the present invention, the bottle has a bend proximal to the open end. All other invention features described herein are contemplated for use with such bent bottle designs.

The dispensing means contemplated for use in the practice of the present invention include a nipple, and the like. The entire nipple assembly may be made of a pliable material suitable for stretching around and being snugly attached to an annular lip incorporated into the open of the bottle, and the like. Alternatively, a pliable nipple may be incorporated into a rigid threaded cap suitable for mounting on a bottle with a screw threaded open end, and the like. Other suitable dispensing means are also contemplated for use in the practice of the present invention.

As will be recognized by those skilled in the art, the various embodiments described herein are provided by way of illustration and not limitation; various modifications and substitutions may be made thereto without departing from the spirit and scope of the invention. Such modifications and substitutions are contemplated as within the scope of the following claims.

That which is claimed is:

1. An open ended nursing bottle, said nursing bottle comprising:

(a) a plurality of visible gradations along its length, (b) a means for identifying an orientation of said nursing bottle wherein said orientation places a liquid contained in said bottle in an aspect for measuring said liquid using said gradations when the nursing bottle is positioned for nursing, and (c) a receiving means for snugly accepting a dispensing means, wherein said means for identifying an orientation of said nursing bottle comprises a bubble level.

2. A nursing bottle according to claim 1, wherein one or more numerical values associated with each of said gradations increases and/or decreases as the distance of said gradation from said open end increases.

3. A nursing bottle according to claim 1, wherein said dispensing means comprises a nipple.

4. A nursing bottle according to claim 1, wherein said means for snugly accepting said dispensing means comprises an annular lip at said open end.

5. A nursing bottle according to claim 1, wherein said means for snugly accepting said dispensing means comprises screw threads around said open end.

6. A nursing bottle according to claim 1, wherein said bottle incorporates a bend.

7. A nursing bottle according to claim 6, wherein said bend is in the range of up to about 90 degrees.

8. A nursing bottle according to claim 6, wherein said bend is in the range of about 10 degrees up to about 60 degrees.

9. A nursing bottle according to claim 6, wherein said bend is about 45 degrees.

* * * * *